US006052870A

United States Patent [19]

Hagenlocher et al.

[11] Patent Number: 6,052,870

[45] Date of Patent: Apr. 25, 2000

[54] DOOR HINGE

[75] Inventors: Jörg Hagenlocher, Deckenpfronn; Karl Köster, Nagold; Robert Schwed, Bad Teinach-Zavelstein; Ralf Mertin, Herdecke-Westende; Dirk Bogner, Dortmund, all of Germany

[73] Assignee: DaimlerChrysler AG, Germany

[21] Appl. No.: 09/207,858

[22] Filed: Dec. 8, 1998

[30] Foreign Application Priority Data

Dec. 9, 1997 [DE] Germany ..... 197 54 417

[51] Int. Cl.[7] ..... E05D 11/10; E05D 11/06

[52] U.S. Cl. ..... 16/347; 16/343; 16/371; 296/146.11; 296/146.12; 180/282

[58] Field of Search ..... 16/222, 319, 343, 16/347, 366, 371; 296/146.11, 146.12; 180/69.21, 282

[56] References Cited

U.S. PATENT DOCUMENTS

| | | | |
|---|---|---|---|
| 2,732,003 | 1/1956 | Williams | 297/378.11 |
| 2,873,794 | 2/1959 | Leslie et al. | 297/378.11 |
| 3,336,075 | 8/1967 | Wilson | 296/146.11 |
| 3,650,557 | 3/1972 | Dudley | 16/354 |
| 4,716,623 | 1/1988 | Kihaga et al. | 16/371 |
| 4,719,665 | 1/1988 | Bell | 16/343 |
| 4,727,621 | 3/1988 | Emery et al. | 16/371 |
| 5,718,019 | 2/1998 | Cheal | 16/222 |

FOREIGN PATENT DOCUMENTS

| | | |
|---|---|---|
| 2364632 | 12/1973 | Germany . |
| 2299617A | 3/1996 | United Kingdom . |

*Primary Examiner*—Chuck Y. Mah
*Assistant Examiner*—Donald M. Gurley
*Attorney, Agent, or Firm*—Snell & Wilmer L.L.P.

[57] ABSTRACT

A door hinge, preferably for a door on a motor vehicle, having a carrying arm, which is articulated on a door bracket and a pillar bracket at the ends in each case, and having a control lever which is articulated on both sides and is intended for controlling a predetermined movement sequence during the opening and closing operations of the door, comprises an element articulated on a part of the door hinge, which element locks the door hinge, preferably automatically, when said door hinge is subjected to pronounced acceleration, especially in case of an accident with high frontal impacts.

14 Claims, 9 Drawing Sheets

DOOR HINGE

FIELD OF THE INVENTION

The present invention relates to a door hinge, preferably for a door on a motor vehicle, having a carrying arm which is articulated on a door bracket and a pillar bracket at the ends in each case, and having a control lever which is articulated on both sides and is intended for controlling a predetermined movement sequence during the opening and closing operations of the door.

DESCRIPTION OF THE PRIOR ART

Door hinges of the abovementioned type have been known, in a wide range of different forms, in the automotive sector for some time now. In the case of these hinges, a door bracket with a vehicle door fastened on it is connected in an articulated manner to a carrying arm which, for its part, is connected to an A-pillar of the motor vehicle via a pillar bracket. A control lever, likewise articulated between the door bracket and the pillar bracket, defines the movement sequence of the gear mechanism during the opening and closing operations. New research has found that such door hinges are surprisingly susceptible to external forces, such as those which occur, in particular, in the case of collisions, and open at least partially, which may be dangerous for vehicle occupants. In addition, it is also the case that partial opening of the door out of the closed vehicle contour in the event of an accident weakens the stability and rigidity of the vehicle compartment.

German offenlegungsschrift 23 64 632 has already disclosed the problem of vehicle doors opening in the case of a collision, and of the associated weakening of the passenger compartment, when very straightforward door hinges are used. This problem is solved here by the provision of a rigid element which is arranged in the region of the door hinge and, by way of a form fit, prevents the vehicle door from moving laterally outwards out of the bodywork contour even in the event of an accident.

GB 2 299 617 A prevents a bonnet from opening in the event of an accident in that two legs of a hinge are moved relative to one another, counter to the restoring force of a spring element, in the region of their common articulation bolt. In the course of this relative movement, which only takes place in the event of an accident, the restoring force of the spring element is overcome and blocking means which are arranged on the two hinge legs in each case engage one inside the other with closing action in the course of the relative movement.

OBJECT OF THE INVENTION

The object of the invention is thus to develop door hinges of the abovementioned type so as to increase their reliability, even in extreme situations.

SUMMARY OF THE INVENTION

This object is achieved according to the invention in that articulated on part of the door hinge is an element which locks the door hinge, preferably automatically by way of its mass inertia, when said door hinge is subjected to pronounced acceleration.

A door hinge according to the invention is thus provided with an additional element which locks the door hinge just in the case of pronounced acceleration, as usually occurs in the event of accidents. This ensures that the vehicle door remains closed within the vehicle contour in the event of an accident. Pronounced deformation of the chassis in collisions with a high proportion of frontal impacts is by far the greatest cause of the vehicle door opening. In the event of such accidents, experience has shown that high accelerations occur, the latter being utilized, in the case of a door hinge according to the present invention, in order to exert a force on an element articulated on the door hinge, with the result that, in one preferred embodiment of the invention, the door hinge is automatically locked by way of the mass inertia of the articulated element. This locking is achieved here without the use of electronic control systems, which in other embodiments may be coupled to the airbag system, for example, by sensors. In the last-mentioned embodiments, however, it is necessary to provide additional motor-driven or magnetic locking measures with the associated cabling. In contrast to locking according to the invention, an active measure of this type contributes to an increase in weight and results in higher costs. The same also applies, in principle, to systems which are driven mechanically, for example, via the door lock.

The articulated element is advantageously designed as a hook-like blocking lever which is articulated on one side. The hinge is locked with a form fit by this blocking lever in the event of an accident, for example by a brief rotary movement being executed. It is preferable, however, for the blocking lever, as soon as the vehicle door has been closed, to be located, under constraint, in a locking position, which is cancelled automatically only when the door is opened under normal circumstances, that is to say outside an accident situation.

In an essential development of the invention, the blocking lever is spring-loaded. Outside an accident situation, the spring, when the door is opened, thus draws the blocking lever back into a predetermined rest position and retains the blocking lever in a position in which the hinge cannot be locked. In a normal state, the vehicle door can thus be actuated without difficulty. The spring force thus subjects the blocking lever to a certain torque in the direction of the non-locking position. Deceleration of the hinge parts causes the mass inertia of the blocking lever to produce a torque in the direction of the locking position. The spring force and mass moment of inertia of the blocking lever are coordinated with one another, by the mass of the blocking lever and the form given to the lever arm of its centre of gravity towards the articulation point, such that the mass moment of inertia only prevails in the case of a certain "accident severity", i.e. deceleration of the bodywork. It is only after this limit deceleration that the blocking lever is then pivoted into the locking position and retained in this position. The limit value for this "accident severity" is the deceleration at which the hinge, without the locking, would open of its own accord for example as a result of accident-induced deformation and/or twisting of the control lever or of the hinge.

Advantageously, the mass of the blocking lever can be set or changed, once the hinge has been finished, by an additional mass element fastened on the blocking lever, for example in the form of a straightforward rotary part. The weight of the mass element can increase the overall weight of the blocking lever to a considerable extent and influence the characteristics of the locking. This mass element also allows the centre of gravity of the blocking lever, and thus its lever arm about the articulation point of the blocking lever, to be freely adapted, within a wide range, to changed circumstances. This may be necessary, for example, for adapting the door hinge to another type of vehicle or for using a spring of different rigidity.

In one development of the invention, a mating element in relation to the locking element, or the articulated hook or blocking lever, in the form of a locking nose or a bolt is arranged on the control lever of the hinge. The locking nose or the bolt may be integrated in the shape of the control lever.

The control lever is advantageously of multi-part design, with the result that the locking nose, for latching the blocking lever on the control lever, can be designed integrally with part of the control lever and can then be adapted variably nevertheless. In addition, the control lever can be adapted in length to each respective case and/or tolerances can be compensated for. In this case, it is made up of straightforwardly formed parts which are connected releasably to one another, for example by a double screwed-connection, for length adjustment and/or for tolerance compensation.

In accordance with safety regulations, it is necessary for the locked door hinge to be able to be opened, even after a frontal crash, by a predetermined pulling force being exerted on the lock of the vehicle door, for example for the purpose of freeing the occupants. This regulation is taken into account in the case of a door hinge in that the lever arm in relation to the blocking lever, locked on the control lever of the hinge, is considerably shorter than the lever arm of the vehicle door from the lock to the common point of rotation. The blocking lever is designed according to the invention such that, when the door is locked and the prescribed pulling force is exerted on the door lock, the breaking limit of the blocking lever is exceeded. The blokking lever breaks at a predetermined point and the door can be opened freely again for the purpose of rescuing the occupants.

In the case of a door hinge according to the invention, the carrying arm, from its pillar-side articulation to the door bracket, advantageously runs obliquely inwards. In the event of a crash with a high proportion of frontal impact, this construction produces a further force component running in the y-direction with respect to the centre axis of the vehicle, and this likewise counteracts opening of the door.

The hinge axes of the carrying arm are preferably inclined by an angle $\alpha$ with respect to the z-axis of the vehicle. In one preferred embodiment, the other pivot axes are aligned parallel to the hinge axes of the carrying arm. The degree of inclination can assist the closing movement of the vehicle door.

A door hinge according to the invention is advantageously produced predominantly as a welded structure using punched sheet-metal parts. Materials and tools thus do not have to meet any stringent requirements as far as the functioning principle of the door hinge is concerned, as a result of which inexpensive production is possible.

In one preferred embodiment of the door hinge, a door arrester is-integrated at the bottom end of the carrying arm. Alongside the two brackets, the carrying arm is the most solid part of the door hinge, with the result that large forces and also torques can be transmitted via the carrying arm. For the purpose of integrating the door arrester, a spring-loaded drag lever is thus arranged, in particular, just in the region of a bottom articulation of the carrying arm on the pillar bracket, said lever engaging in latching means of the carrying arm by way of a roller mounted at the end of the drag lever. The latching means may be fixedly predetermined, as grooves in a punched part of the carrying arm, as will be seen in relation to an exemplary embodiment which will be described in more detail hereinbelow. The door arrester is thus fastened directly on the pillar bracket as an integral constituent part of the door hinge. In the case of a preferred short overall length of the drag lever, the latching mechanism is very tolerant even with respect to production inaccuracies. In order to generate a sufficiently large moment in the case of a short lever arm in relation to the point of rotation of the carrying arm, a relatively large force is necessary, this preferably being produced by a spring with high spring rigidity. This design renders the arrester very insensitive to dirt and/or paint residues, since the obstructions which may be produced in this way have only comparatively small resistance forces. The straightforward construction thus allows the door arrester to be operated without any further protection against dirt. It is thus also possible for the door arrester, together with the installed hinge, to be guided, without any additional protection, through the paint-shop of an automotive production line.

BRIEF DESCRIPTION OF THE DRAWINGS

An embodiment of the invention is explained in more detail hereinbelow, with reference to the drawing, in which.

DETAILED DESCRIPTION OF THE DRAWINGS

Figure 1:
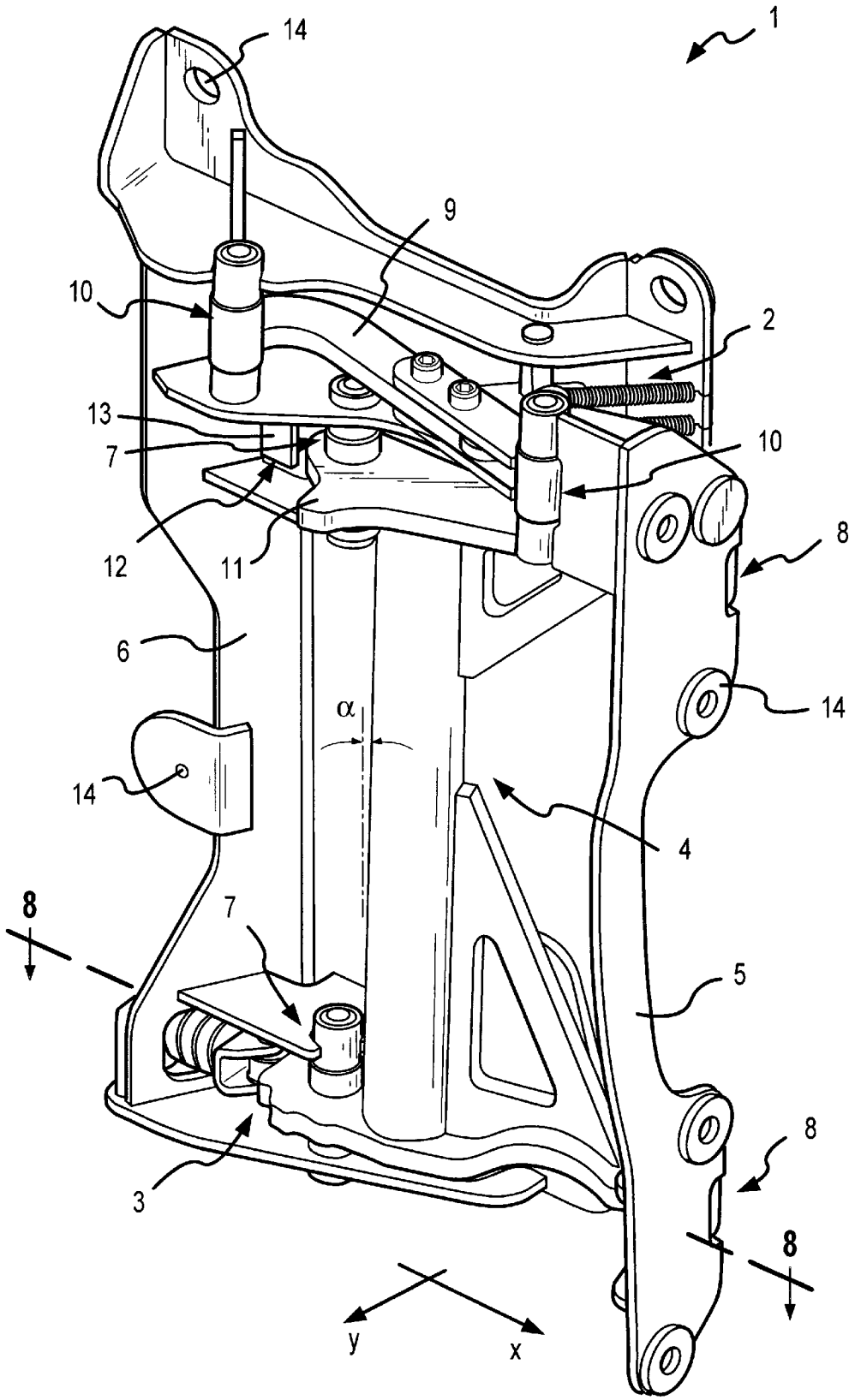
FIG. 1 shows a three-dimensional illustration, as seen from the outside, of a complete door hinge with crashlocking mechanism.

FIG. 1 illustrates a three-dimensional view of a complete door hinge 1 with crash-locking mechanism 2 and an integrated door arrester 3. In this case, the door hinge 1 is designed as a welded structure using straightforward punched and bent sheet-metal parts. It comprises a carrying arm 4, which is articulated, via double bearings and/or bearing point 7, 8 in each case, between a door bracket 5 and a pillar bracket 6. The hinge axes formed from the bearing points 7, 8 are tilted through an angle a with respect to the direction of the z-axis, that is to say normal to the x-y-plane, in order to facilitate the closing movement of the door.

A multi-part control lever 9 is articulated, via bearings 10, above the carrying arm 4. In the event of an accident, the control lever 9 interacts with the crash-locking mechanism 2 in order thus to prevent a vehicle door (not depicted here) from opening. This special locking will be illustrated in detail with reference to FIGS. 6 and 7.

At the articulation 7 in its top region, the carrying arm 4 is provided with a stop protrusion 11 which, in order to limit a maximum opening angle of the door hinge 1, pushes against an end stop 12 provided on the pillar bracket 6. A damping element 13 made of plastic or rubber is arranged on the end stop 12 in order to damp the impact of the stop protrusion 11 thereon.

The door hinge 1 is installed via fastening holes 14 located in mutually perpendicular vehicle planes. This makes it easier to compensate for tolerances during installation of a vehicle door in automotive production since the compensating measures can be carried out separately from one another in each case. Likewise, a multi-part construction of the control lever 9 serves to compensate for body-shell tolerances. Releasing a double screwed-connection makes it possible for the overall length of the control lever 9 to be easily adapted, the arrangement which is illustrated also helping to stiffen the control lever 9 in addition.

Figure 2:
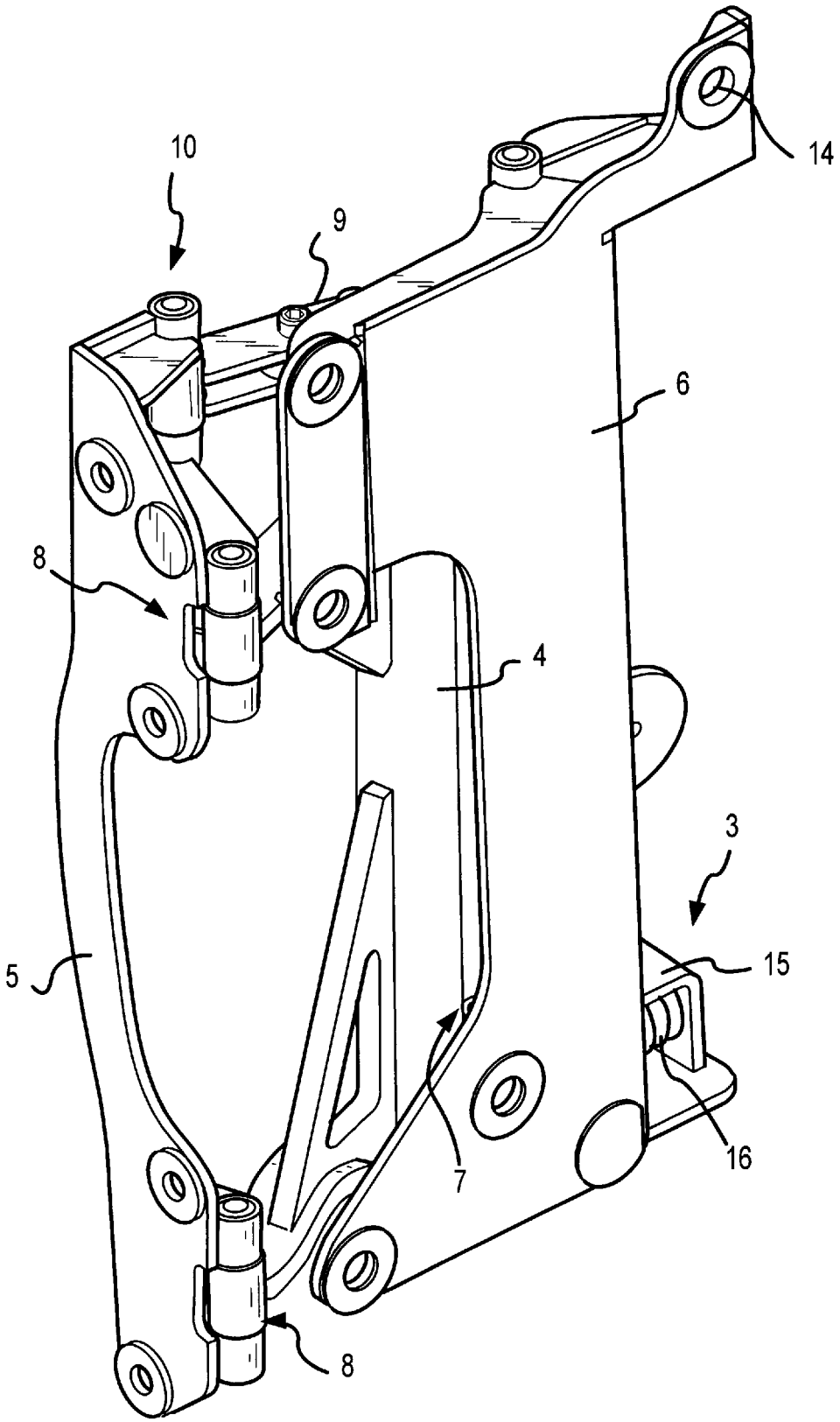
FIG. 2 shows a view of the door hinge from FIG. 1, as seen from the vehicle interior.

FIG. 2 illustrates a further view of the door hinge from FIG. 1, as seen from the vehicle interior. In particular the articulations 8, 10 of the carrying arm 4 and the control lever 9, respectively, on the door bracket 5 can easily be seen in this view. In addition, an outer part of the door arrester 3 is illustrated in the region of the bottom articulation 7 of the carrying arm 4 on the pillar bracket 6, said outer part of the door arrester, in the form of a bent sheet-metal angled part 15 which is welded on the pillar bracket 6, retaining a spring element 16 in position under prestressing.

Figure 3:
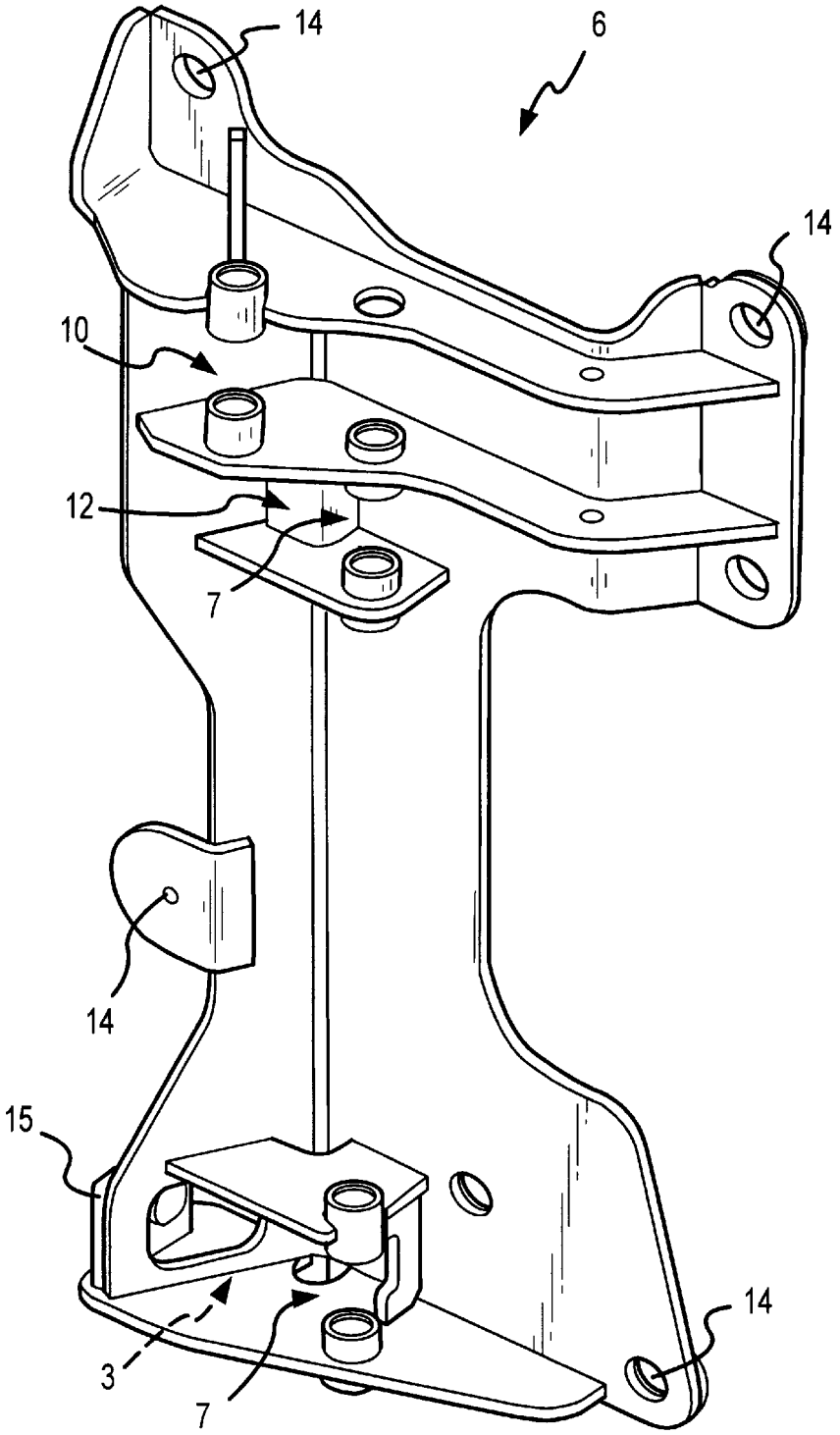
FIG. 3 shows a three-dimensional illustration of the pillar bracket of the door hinge from FIGS. 1 and 2.

FIG. 3 shows a three-dimensional illustration of the pillar bracket 6 of the door hinge 1 from FIGS. 1 and 2 as a finished bent sheet-metal part, which has been welded together, with the sleeves of the bearings 7, 10 inserted. From the arrangement of the bearings 7 in the pillar bracket 6, this representation shows the tilting, illustrated in FIG. 1, of the carrying arm 4 through an angle $\alpha$. The end stop 12 and parts of the later-inserted door arrester 3 have been finished as a constituent part of the pillar bracket 6, with a small number of punching operations, by way of bending alone. It is only the angled sheet-metal part 15 of the door arrester 3 which has to be welded on the pillar bracket 6 as an additional, individual part, which does not carry any bearing or bearing sleeve.

Figure 4:
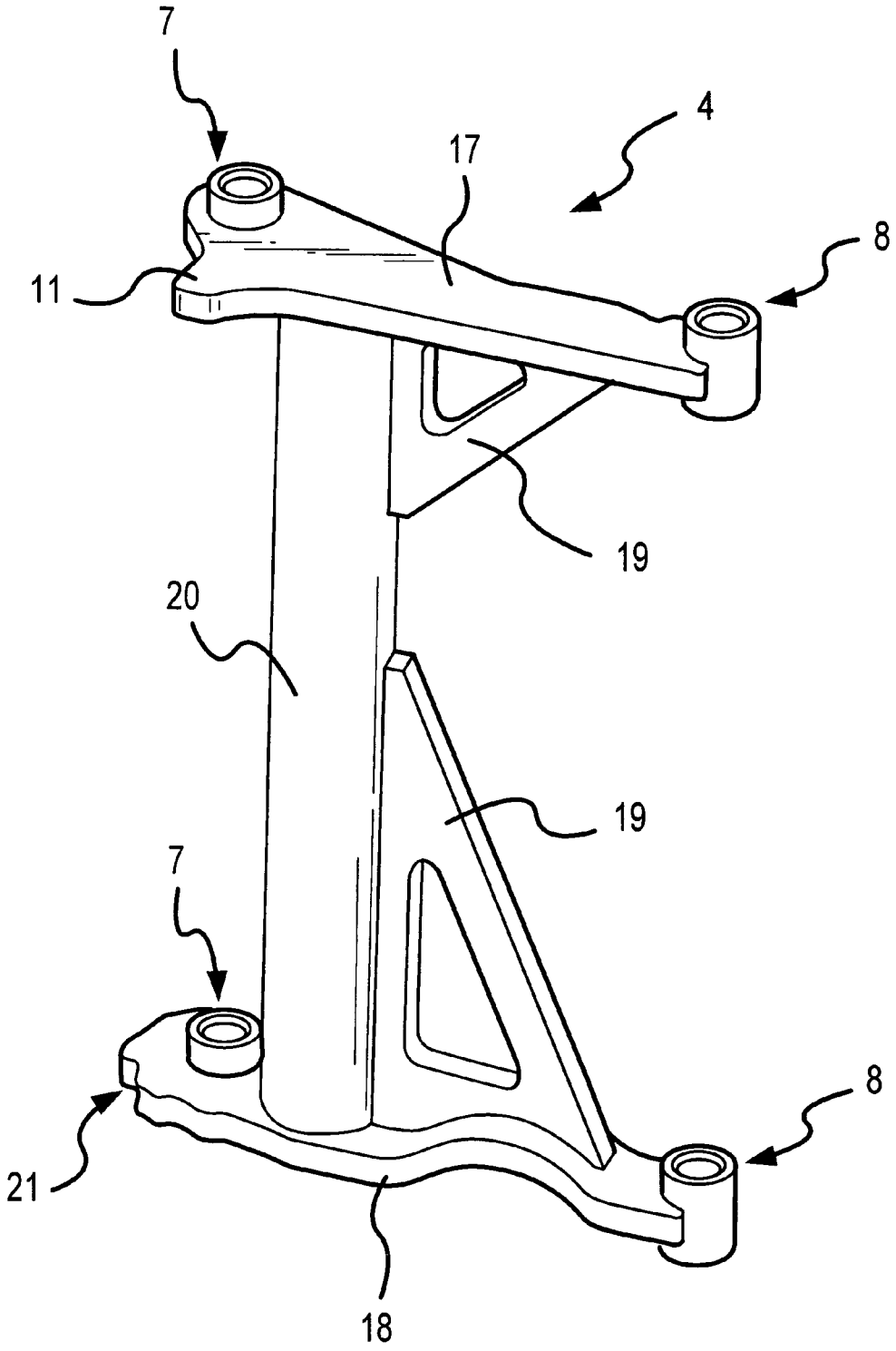
FIG. 4 shows a view of the carrying arm of the door hinge from FIG. 1.

FIG. 4 illustrates a view of the carrying arm 4 from the door hinge 1 from FIG. 1 as a finished individual part. The sleeves of the bearings 7, 8 are each accommodated in a top flange 17 and a bottom flange 18, which, with the aid of stiffening means 19, are connected to one another via a tubular element 20. The stop protrusion 11 is arranged in the region of the bearing 7 on the top flange 17. Advantageously, this stop protrusion is similarly designed integrally with the top flange 17. On the bottom flange 18, latching grooves 21 are arranged in the region of the bearing 7. A detailed description of the door arrester 3 will be given with reference to FIG. 8.

Figure 5:
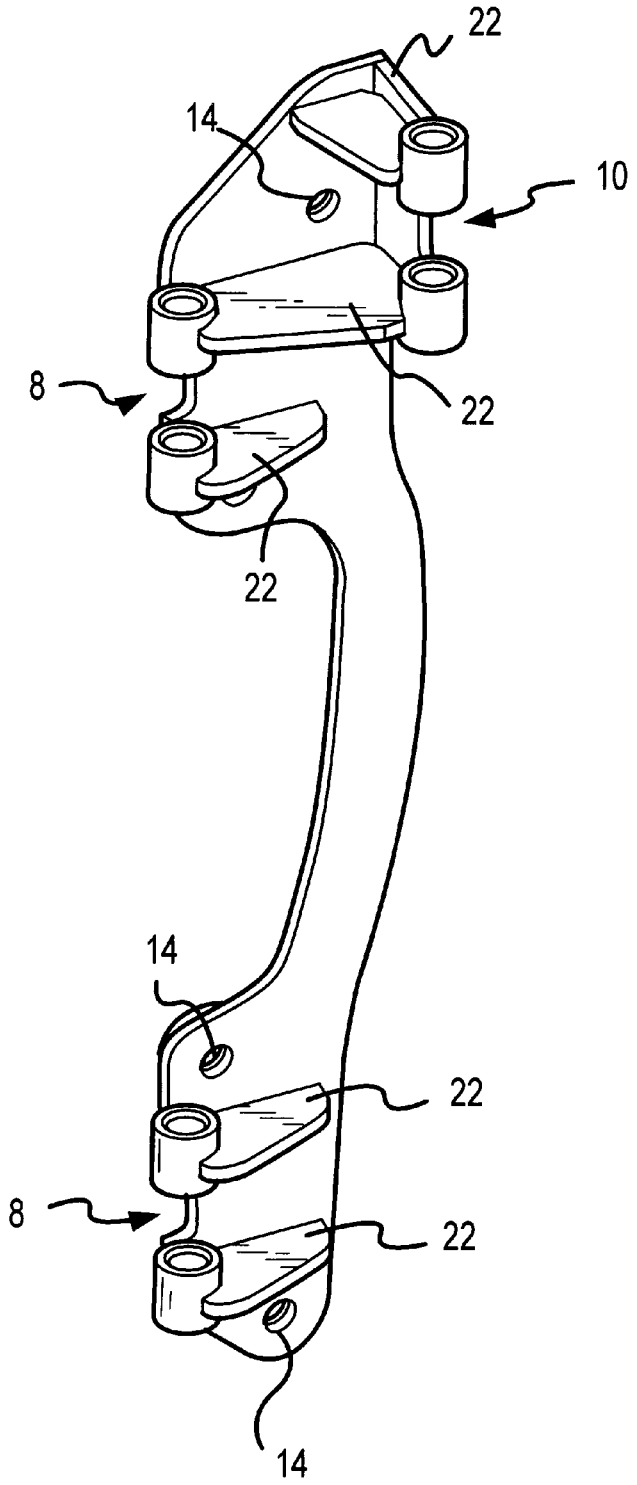
FIG. 5 shows an illustration merely of the door bracket of the door hinge from FIG. 1 alone.

FIG. 5 shows an illustration of the door bracket 5 of the door hinge 1 from FIG. 1 as a part which is ready for installation. This, in turn, is a welded structure made of punched sheet-metal elements, rib-like strut arrangements 22 being welded on a continuous sheet-metal element with fastening holes 14, and the strut arrangements accommodating the sleeves of the bearings 8, 10 in each case.

Figure 6:
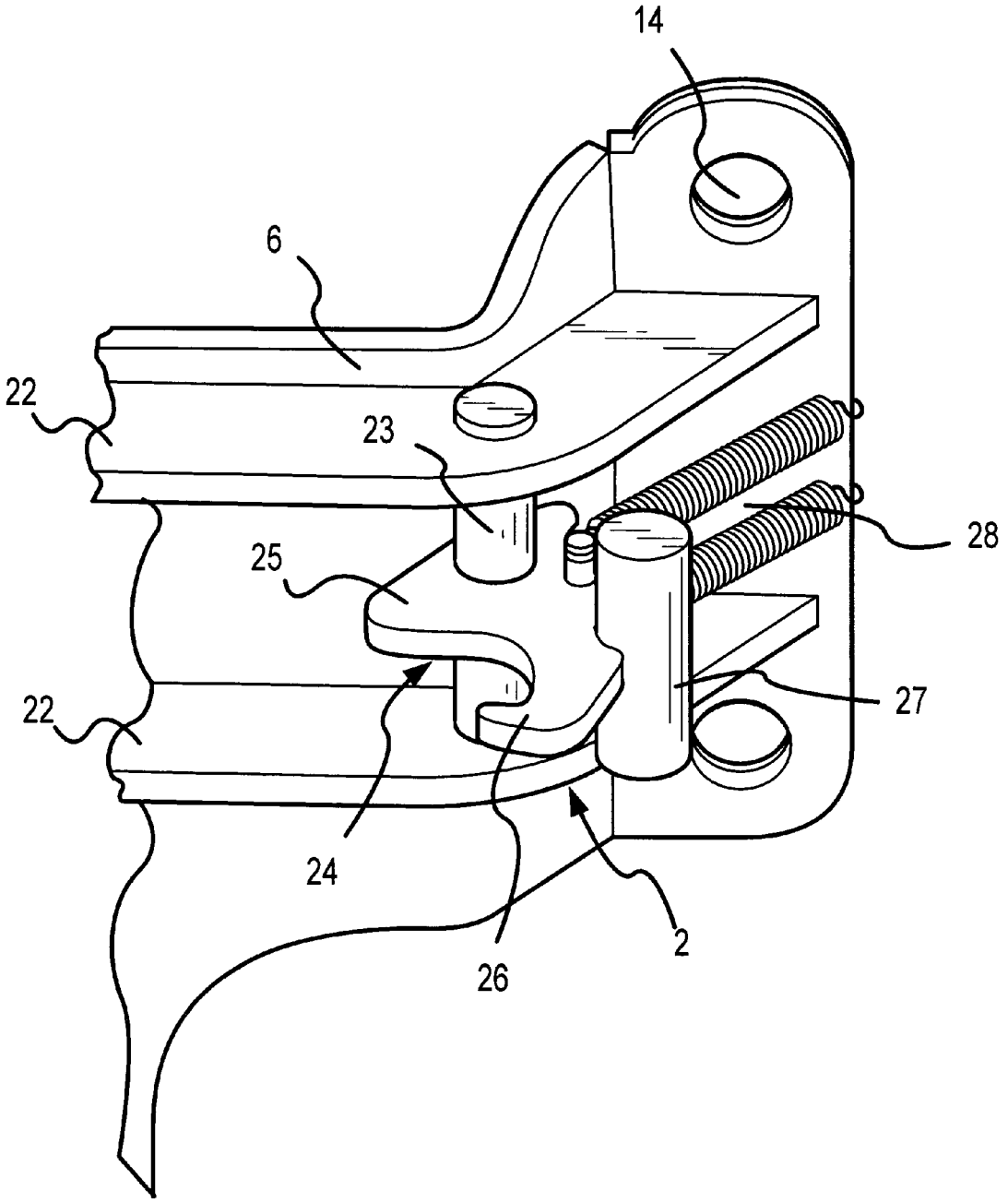
FIG. 6 shows an enlarged detail from the illustration from FIG. 1.

FIG. 6 is an enlarged detail from the illustration from FIG. 1, although in this case the hinge 1 is illustrated in the open state. The enlarged detail of FIG. 6 illustrates precisely that part of the pillar bracket 6 in which an essential part of the crash-locking mechanism 2 is arranged. In the vicinity of two fastening holes 14, which are arranged at the end of the pillar bracket 6, a hook-like blocking lever 24 is articulated via a bolt 23. The blocking lever 24 comprises a protrusion 25 and a nose 26, the latter being the part which actually allows the blocking lever to function as such. Furthermore, fastened on the blocking lever 24 is an additional weight element and/or mass element 27 which, in addition to the centre of gravity, can also set the overall weight of the blocking lever 24.

In the open state of the hinge 1, the blocking lever 24, which is mounted rotatably on the bolt 23 in this way, is drawn back by a spring arrangement (element) 28 into a wide-open rest position. In the present case, the spring arrangement 28 is made of two helical springs subjected to tensile loading. However, instead of the spring arrangement, it is also possible for a torsion spring to be arranged around the axis of the bolt 23.

Figure 7:
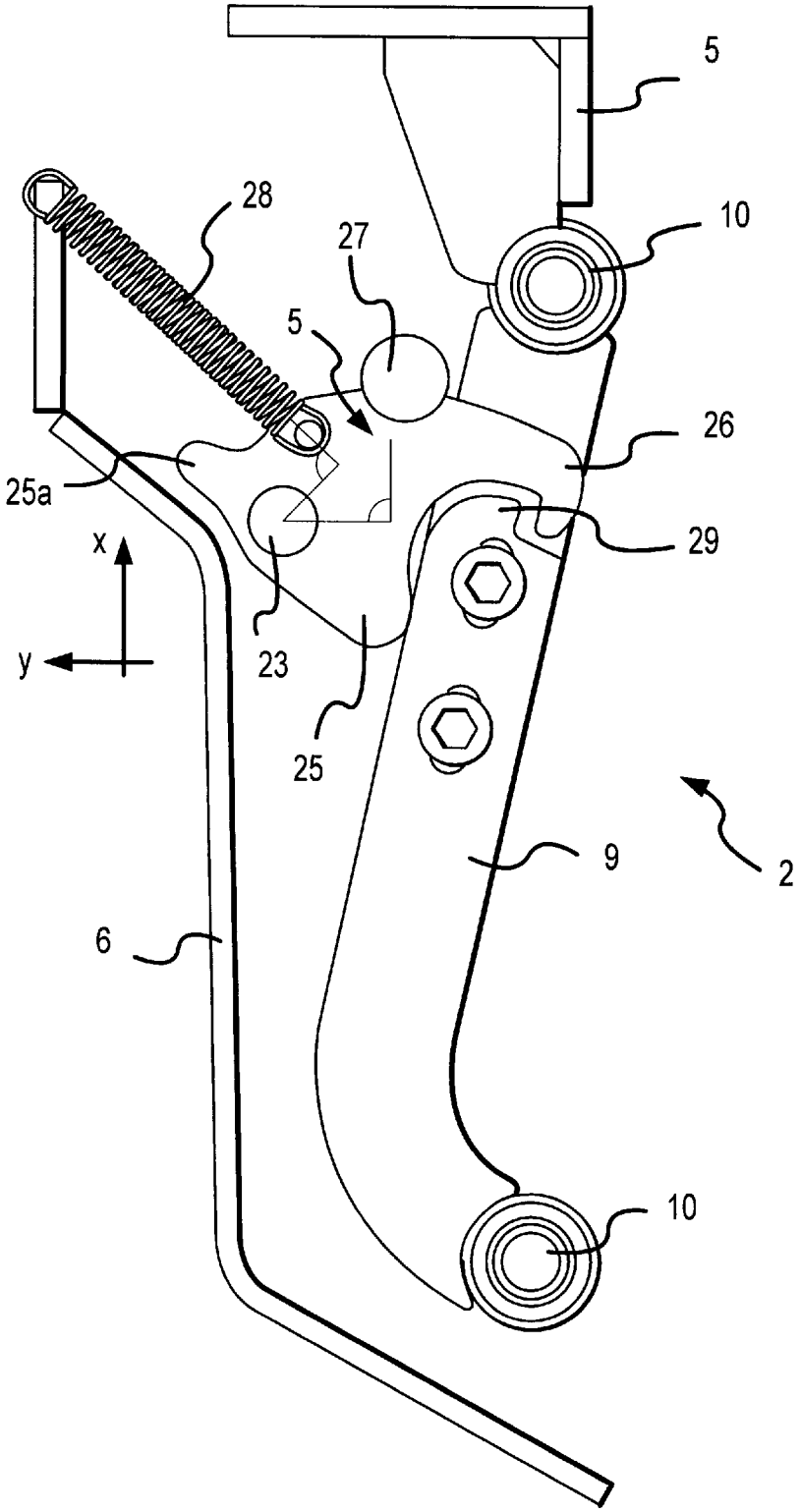
FIG. 7 shows a plan view of the door hinge from FIG. 1 in the closed state.

In order to illustrate the functioning of the crashlocking mechanism 2, FIG. 7 shows a plan view of the door hinge 1 from FIG. 1 in the closed state. For reasons of clarity, the number of elements of a door hinge 1 which are illustrated has been reduced. In the closed state, the control lever 9 pushes against the protrusion 25 of the blokking lever 24, with the result that the latter rotates about the bolt 23 as articulation point. In this case, the spring arrangement 28, which is likewise articulated on the blokking lever 24, is prestressed. The blocking lever 24 is thus retained, under constraint, in a locking position. When the vehicle door is opened normally, the control lever 9 rotates about its pillar-bracket-side bearing point 10, as a result of which the pressure on the protrusion 25 of the blocking lever 24 decreases and, consequently, the blocking lever is drawn back around the bolt 23 by the prestressed spring arrangement 28. In this case, the nose 26 of the blocking lever 24 releases a locking nose 29 arranged on the control lever 9, as a result of which further opening of the vehicle door is possible without any difficulty. However, the blokking lever 24 is never moved beyond the predetermined opening position since, otherwise, it would also be able to pass, detrimentally, into a dead-centre position. In such a case, it would no longer be possible for the hinge 1 to be closed. This is prevented by a second protrusion 25*a*, which, as the predetermined end position of the blocking lever 24 is reached, strikes against the pillar bracket 6.

In the event of an accident with a high proportion of frontal impact, and in particular in the case of a frontal collision, it is likewise possible, as a result of the plastic deformation of the vehicle chassis, for the control lever 9 to be changed in position, by rotation or some other displacement movement relative to the articulation 23 of the blocking lever 24, such that the control lever 9 no longer pushes against the protrusion 25. This means that, even in the event of an accident, it would be possible for the blokking lever 24 to be moved by the spring arrangement 28 into an unlocked, open position. In the event of such an accident, however, high acceleration forces occur. Together with the acceleration, the mass of the blocking lever then produces a force which from a centre of gravity S of the blocking lever 24, acting around the bolt 23, generates a moment which compensates for, and/or overcomes, the restoring moment of the spring arrangement 28. Thus, even in the case of plastic deformation of the hinge 1 during the accident, the blocking lever 24 will remain in its locked position and thus secure the hinge against opening. In correspondence with the spring force of the spring arrangement 28, the additional weight element 27 is arranged with a predetermined mass on the blocking lever 24, in order to increase the weight of the blocking lever 24 as a whole. Furthermore, it is possible for the weight distribution over the blocking lever 24 to be set, by displacement of the additional weight element 27, such that the position of the centre of gravity S can be adapted to the locking conditions. FIG. 7 outlines the respective lever arms, from which the great influence of a displacement of the centre of gravity S on the function of the crash-locking mechanism 2 becomes clear.

Figure 8:
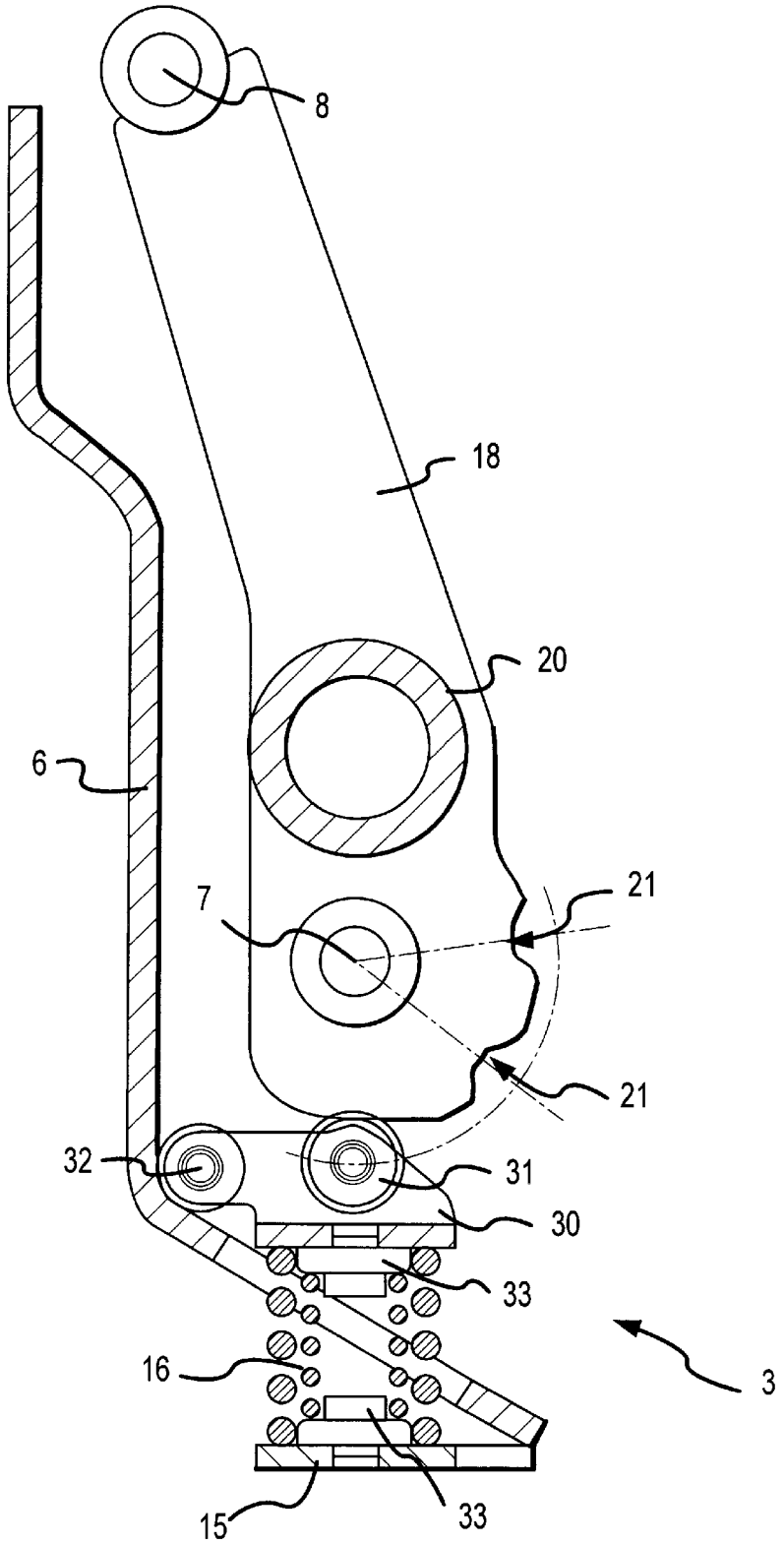
FIG. 8 shows a sectional illustration along a plane A—A from FIG. 1.

FIG. 8 is a sectional illustration along the plane A—A from FIG. 1 for the purpose of illustrating the door arrester 3 when the door hinge 1 is closed. In the region of the bearing 7, latching grooves 21 are arranged on the bottom flange 18 of the carrying arm 4, in the region of an outer contour of said flange which is in the form of a segment of a circle. A roller 31 which is loaded by the spring element 16 and is mounted in a drag lever 30 pushes against this region. The drag lever 30 can rotate about its articulation 32 to the extent where the roller 31, which is spring-loaded by the spring element 16, can engage in one of the latching grooves 21 in each case when the door or the door hinge 1 is opened, with the result that the door hinge 1, or the door fastened thereon, can assume fixedly defined intermediate positions, which secure the door against accidentally slamming shut.

Opposite the drag lever 30, the angled sheet-metal part 15 is welded to the pillar bracket 6. The angled sheet-metal part 15 and the drag lever 30 carry centring elements 33 in order to fix the spring element 16 reliably.

The spring excursion used in this arrangement of the door arrester 3 is very small, since the lever arm around the bearing 7 is very small as well. Thus, an appropriately high spring force has to be applied in order to generate a sufficiently large arresting moment to secure the vehicle door against unintended movement. In the present case, for this purpose, two straightforward helical springs have been inserted concentrically one inside the other and arranged parallel to one another, in order for the necessary spring rigidity to be realized by simple means. The arrester 3, which is integrated in the door hinge 1, operates, using components which are not adversely affected by dirt and are also resistant to chemicals and/or heat, with forces of such a magnitude that, for example, dirt or even paint cannot impair the functioning of the door arrester 3. The torques which occur during the actuation of the door hinge 1 are of such a magnitude that any parts which are possibly stuck together by paint or other coatings in the course of a vehicle-painting operation are reliably pulled apart; in addition, the high contact-pressure forces of the roller 31 in the drag lever 30 ensure that the latching grooves 21 are rapidly freed of any adverse coating. As a result, the door arrester 3 described does not need any additional protection against dirt even as it is passing through a paintshop or when the vehicle is being used normally in wet conditions.

Figure 9:
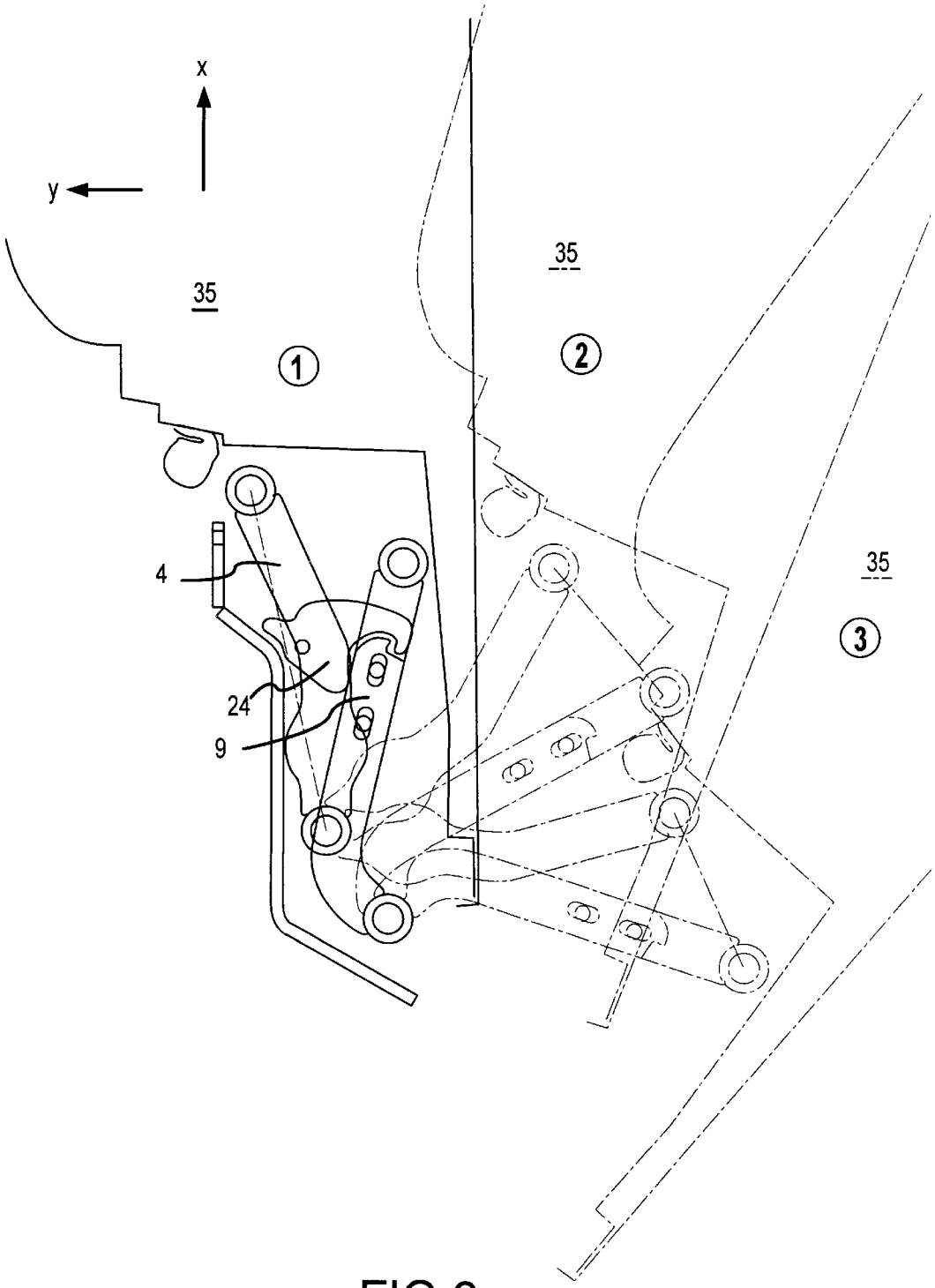
FIG. 9 shows an outline of the kinematics of the door hinge from FIG. 1.

FIG. 9 outlines the kinematics of the door hinge 1 from FIG. 1, with three intermediate positions being illustrated in a plan view. The closed state ① corresponds essentially to FIG. 7. It can be seen, with reference to the dashed line depicted, that the carrying arm 4, in the closed position of the door hinge 1, has a clear component in the direction of the centre axis of the vehicle, that is to say in the y-direction. In the case of the vehicle chassis being compressed in the event of an accident, this y-component may likewise produce a force which may additionally serve for closing, or keeping closed, a vehicle door 35. The normal crash-locking mechanism 2, however, works by way of the locking nose 29 of the control lever 9 together with the locking nose 26 of the blocking lever 24.

② and ③ respectively show possible intermediate and end positions of the vehicle door 35 in the normal state, that is to say outside an accident situation. In these positions, latching grooves 21, for example, may be provided for the door arrester 3, in order to retain this intermediate position and to form a reliable end stop in interaction with the stop protrusion 11 of the carrying arm, as has been explained in relation to FIG. 1.

What is claimed is:

1. A door hinge, comprising a carrying arm which is articulated on a door bracket and a pillar bracket at the ends in each case, and having a control lever which is pivotally connected on both sides between the door and pillar brackets and is intended for controlling a predetermined movement sequence during the opening and closing operations of the door, wherein pivotally connected on part of the door hinge is a blocking lever which locks the door hinge by engaging the control lever, preferably automatically by way of its mass inertia, when a certain deceleration of the hinge parts is exceeded.

2. Door hinge according to claim 1, wherein the blocking lever is in the form of a hook, which is pivotally connected on one side.

3. Door hinge according to claim 2, wherein in the non-locked state, the blocking lever (24) is moved by a spring element (28) into a predetermined rest position.

4. Door hinge according to claim 2, wherein the mass moment of inertia of the blocking lever about a pivot point of the blocking lever is of such a magnitude that the locking action only takes place when a certain deceleration of the hinge parts is exceeded.

5. Door hinge according to claim 2, wherein fastened on the blocking lever (24) is an additional mass element (27), which displaces a centre of gravity (S) of the blocking lever (24).

6. Door hinge according to claim 2, wherein a locking nose (29) or a bolt, in which the blowing lever (24) engages, is arranged on the control lever (9).

7. Door hinge according to claim 2, wherein the blokking lever (24) is designed for a certain breaking force.

8. Door hinge according to claim 1, wherein the control lever (9) is of multi-part design.

9. Door hinge according to claim 1, wherein from a pillar-side articulation (7) to the door bracket (5), the carrying arm (4) is directed obliquely inwards.

10. Door hinge according to claim 9, wherein axes of bearings of the carrying arm are inclined by an angle δ with respect to the direction of the z-axis.

11. Door hinge according to claim 10, wherein a flange of the carrying arm has grooves in which a roller engages, said roller being spring-loaded.

12. Door hinge according to claim 11, wherein the roller is mounted in a lever which is pivotally connected on the pillar bracket.

13. Door hinge according to claim 9, wherein a flange (17, 18) of the carrying arm (4) has grooves (21) in which a roller (31) engages, said roller being spring-loaded.

14. Door hinge according to claim 13, wherein the roller is mounted in a lever which is pivotally connected on a pillar bracket.

* * * * *